US007585035B2

(12) United States Patent
Kakuno et al.

(10) Patent No.: US 7,585,035 B2
(45) Date of Patent: Sep. 8, 2009

(54) MARKING DEVICE AND METHOD FOR GOLF BALL

(75) Inventors: Shinji Kakuno, Moriguchi (JP); Masaaki Amasaki, Izumiotsu (JP); Kuniyasi Horiuchi, Kobe (JP); Hiroshi Kawami, Kobe (JP)

(73) Assignee: SRI Sports Limited, Kobe (JP)

( * ) Notice: Subject to any disclaimer, the term of this patent is extended or adjusted under 35 U.S.C. 154(b) by 378 days.

(21) Appl. No.: 11/214,811

(22) Filed: Aug. 31, 2005

(65) Prior Publication Data

US 2006/0050095 A1 Mar. 9, 2006

(30) Foreign Application Priority Data

Sep. 8, 2004 (JP) ..... 2004-260455

(51) Int. Cl.
*B41J 25/308* (2006.01)
*B05D 1/28* (2006.01)

(52) U.S. Cl. ..... 347/8; 427/428.01

(58) Field of Classification Search ..... 347/28, 347/37, 1–9; 528/326; 523/160; 525/93; 427/258, 428.01–428.21; 101/163, 483; 356/237.1; 473/378
See application file for complete search history.

(56) References Cited

U.S. PATENT DOCUMENTS

| | | | | |
|---|---|---|---|---|
| 4,060,031 | A * | 11/1977 | Philipp | 101/163 |
| 5,412,411 | A * | 5/1995 | Anderson | 347/28 |
| 5,668,581 | A * | 9/1997 | Tsuji et al. | 347/37 |
| 6,245,386 | B1 * | 6/2001 | Felker et al. | 427/258 |
| 6,273,536 | B1 | 8/2001 | Nozawa | |
| 6,462,812 | B1 * | 10/2002 | Heene et al. | 356/237.1 |
| 6,825,272 | B2 * | 11/2004 | Fushihara et al. | 525/93 |
| 7,048,651 | B2 * | 5/2006 | Kennedy et al. | 473/378 |
| 7,105,628 | B2 * | 9/2006 | Kuntimaddi et al. | 528/326 |
| 2004/0089184 | A1 * | 5/2004 | Lampinski et al. | 101/483 |
| 2005/0192378 | A1 * | 9/2005 | Uang | 523/160 |

FOREIGN PATENT DOCUMENTS

| | | | |
|---|---|---|---|
| JP | 7-186405 | A | 7/1995 |
| JP | 8-322967 | A | 12/1996 |
| JP | 8-337040 | A | 12/1996 |
| JP | 10-323994 | A | 12/1998 |

(Continued)

*Primary Examiner*—Hai C Pham
(74) *Attorney, Agent, or Firm*—Birch, Stewart, Kolasch & Birch, LLP

(57) ABSTRACT

A marking device includes an ink jet printer (6) using an on-demand system. The printer (6) includes a body (18), a head (22), a slide table (24), a tray (26), an ink vessel (28), a solvent vessel (30), a pump (32) and a rest (34). The head (22) has a nozzle. The shortest distance between the tip of the nozzle and a golf ball (46) set into the tray (26) is equal to or greater than 0.2 mm. The ink vessel (28) is filled with an oil-based ink or an ultraviolet setting type ink. The ink is fed to the head (22) through a tube (48). The ink is discharged from the nozzle and is then moved to the surface of the golf ball (46). The solvent is supplied from the solvent vessel (30) toward the rest (34) through a tube (50) and the pump (32). When the printer (6) is stopped, the nozzle is immersed in the solvent of the rest (34).

5 Claims, 5 Drawing Sheets

FOREIGN PATENT DOCUMENTS

| | | | | |
|---|---|---|---|---|
| JP | 2000-15788 | A | | 1/2000 |
| JP | 2000246916 | A | * | 9/2000 |
| JP | 2002-337329 | A | | 11/2002 |
| JP | 2002337329 | A | * | 11/2002 |
| JP | 2003-264078 | A | | 9/2003 |
| JP | 2004-174836 | A | | 6/2004 |
| JP | 2004-243033 | A | | 9/2004 |

* cited by examiner

MARKING DEVICE AND METHOD FOR GOLF BALL

This application claims priority on Patent Application No. 2004-260455 filed in JAPAN on Sep. 8, 2004, the entire contents of which are hereby incorporated by reference.

BACKGROUND OF THE INVENTION

1. Field of the Invention

The present invention relates to a suitable device for printing a mark on a golf ball. More particularly, the present invention relates to a device using an ink jet printer utilizing an on-demand system.

2. Description of the Related Art

A golf ball manufacturer prints a mark on the surface of a golf ball and ships the golf ball. The mark includes characters, graphics, a combination of the characters and the graphics, and the like. Typically, the trademark of the golf ball is printed. The mark representing the trademark is referred to as a main mark. A user specifies the kind of the golf ball by taking the main mark as a clue. In some cases, a mark corresponding to the user is also printed on the golf ball. The mark is referred to as an own name mark. Specific examples of the own name mark include the name of a user, a company name, a company badge and a catchphrase. A lot in the case in which the own name mark is printed is much smaller than a lot in the case in which the main mark is printed. A method of printing a mark on a golf ball includes a type printing system, a transfer film system and a pad system.

For the type printing system, a type and a color film are used. In the printing, it is necessary to prepare the type in advance. For this reason, a long period is required from an order to a print. In the type printing system, it is impossible to print a fine line. In addition, in the type printing system, it is hard to carry out printing on the surface of a dimple. In recent years, the printing has rarely been carried out by using the type printing system.

In the transfer film system, a transfer film obtained by intaglio printing is used. The transfer film is expensive. In the intaglio printing, a large number of transfer films are manufactured at a time. Therefore, the transfer film system is not suitable for printing the own name mark in a small lot. In the transfer film system, furthermore, it is impossible to print a mark having a large size.

In the pad system, it is necessary to prepare the same number of inks and intaglios as the number of the colors of a mark. In the pad system, a great deal of time and labor is required for manufacturing the intaglio and toning the ink. Since a potlife of the ink is short, it is necessary to often exchange the ink in the pad system. In addition, in the pad system, a great deal of time and labor is required for washing an intaglio, a pad and an ink tray.

Japanese Laid-Open Patent Publication No. 2002-337329 has disclosed a method of printing a mark on a golf ball by an ink jet printer. In this method, it is possible to print a fine line. The ink jet printer is also suitable for printing an own name mark in a small lot. In the ink jet printer, the toning and the washing are not required. In the ink jet printer, it is not necessary to prepare a form plate.

The ink jet printer includes a continuous system and an on-demand system. In the ink jet printer using the continuous system, an ink is always discharged from a nozzle and an electric charge is added if necessary so that the ink is moved toward an object to be printed (typically, a paper). The ink jet printer using the continuous system is mainly utilized in commercial printing. In the ink jet printer using the on-demand system, an ink is discharged from a nozzle only if necessary. The printing is often carried out over a golf ball in a small lot. Therefore, the ink jet printer using the on-demand system is suitable for the printing.

The golf ball has a large number of dimples on a surface thereof. In the case in which the printing is carried out over the golf ball by the ink jet printer, a turbulent flow is generated by the dimples in the discharge of an ink. Due to the turbulent flow, the ink sticks to the nozzle. In the ink jet printer using the on-demand system, the discharge of the ink is temporarily stopped. In some cases, therefore, the ink sticking to the nozzle is dried to block the nozzle. Moreover, the turbulent flow causes a mark to be blurred. In some cases, furthermore, the amount of the ink sticking to the edge of the dimple becomes insufficient due to the turbulent flow.

In the printing for the golf ball, a ground is a cover or a coated layer formed on the surface of the cover. Both the cover and the coated layer are formed of a polymer such as a synthetic resin. The ground absorbs a water content with difficulty. An oil-based ink and an ultraviolet setting type ink are suitable for the printing over the golf ball. In the case in which the oil-based ink or the ultraviolet setting type ink is used, a nozzle is often clogged with the ink. The clogging of the nozzle deteriorates a productivity.

It is an object of the present invention to provide a marking device for a golf ball in which a clear mark can be obtained efficiently.

SUMMARY OF THE INVENTION

A marking device for a golf ball according to the present invention comprises an ink jet head using an on-demand system and a stand for setting the golf ball thereto. The shortest distance between the tip of the nozzle of the ink jet head and the golf ball set into the stand is equal to or greater than 0.5 mm.

By the marking device, a clear mark can be obtained efficiently at a low cost. The marking device is particularly suitable for printing over a golf ball in a small lot.

It is preferable that an oil-based ink or an ultraviolet setting type ink should be used in the marking device. It is preferable that the marking device should further comprise a vessel filled with an ink, a tube for supplying an ink from the vessel to the ink jet head, and an elastic member for changing a position of the vessel corresponding to a residual amount of the ink. It is preferable that the marking device should further comprise a rest in which the nozzle is positioned when the ink jet head is stopped, a vessel filled with a solvent, and supply means for forcibly supplying the solvent from the vessel to the rest.

A golf ball marking method according to the present invention comprises the steps of:

printing a mark on the golf ball by means of an ink jet head using an on-demand system including a nozzle in which the shortest distance from the golf ball is equal to or greater than 0.5 mm; and applying a clear paint on the mark by using a pad and an intaglio subjected to shading.

It is preferable that the marking method should further comprise the steps of:

relatively changing a position to the intaglio in the golf ball to which the clear paint is applied; and applying the clear paint again by using the pad and the intaglio.

DESCRIPTION OF THE PREFERRED EMBODIMENTS

The present invention will be described below in detail based on a preferred embodiment with reference to the drawings.

Figure 1:
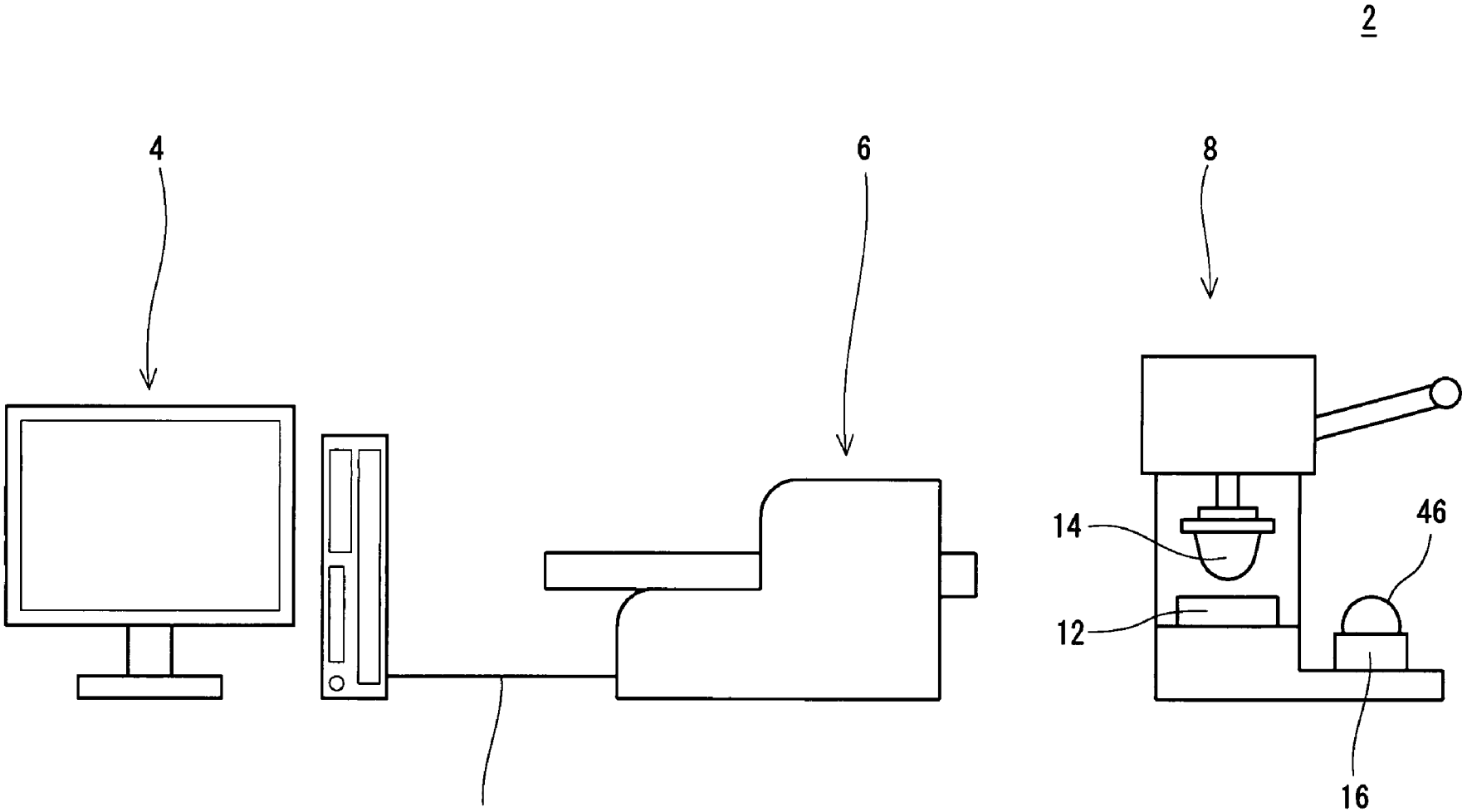
FIG. 1 is a conceptual view showing a marking device for a golf ball according to an embodiment of the present invention.

A marking device 2 shown in FIG. 1 comprises a personal computer 4, an ink jet printer 6 and a pad printing machine 8. The computer 4 and the printer 6 are connected to each other through a cable 10. The pad printing machine 8 includes an intaglio 12, a pad 14 and a cup 16. The well-known pad printing machine 8 can be used in the marking device 2.

Figure 2:
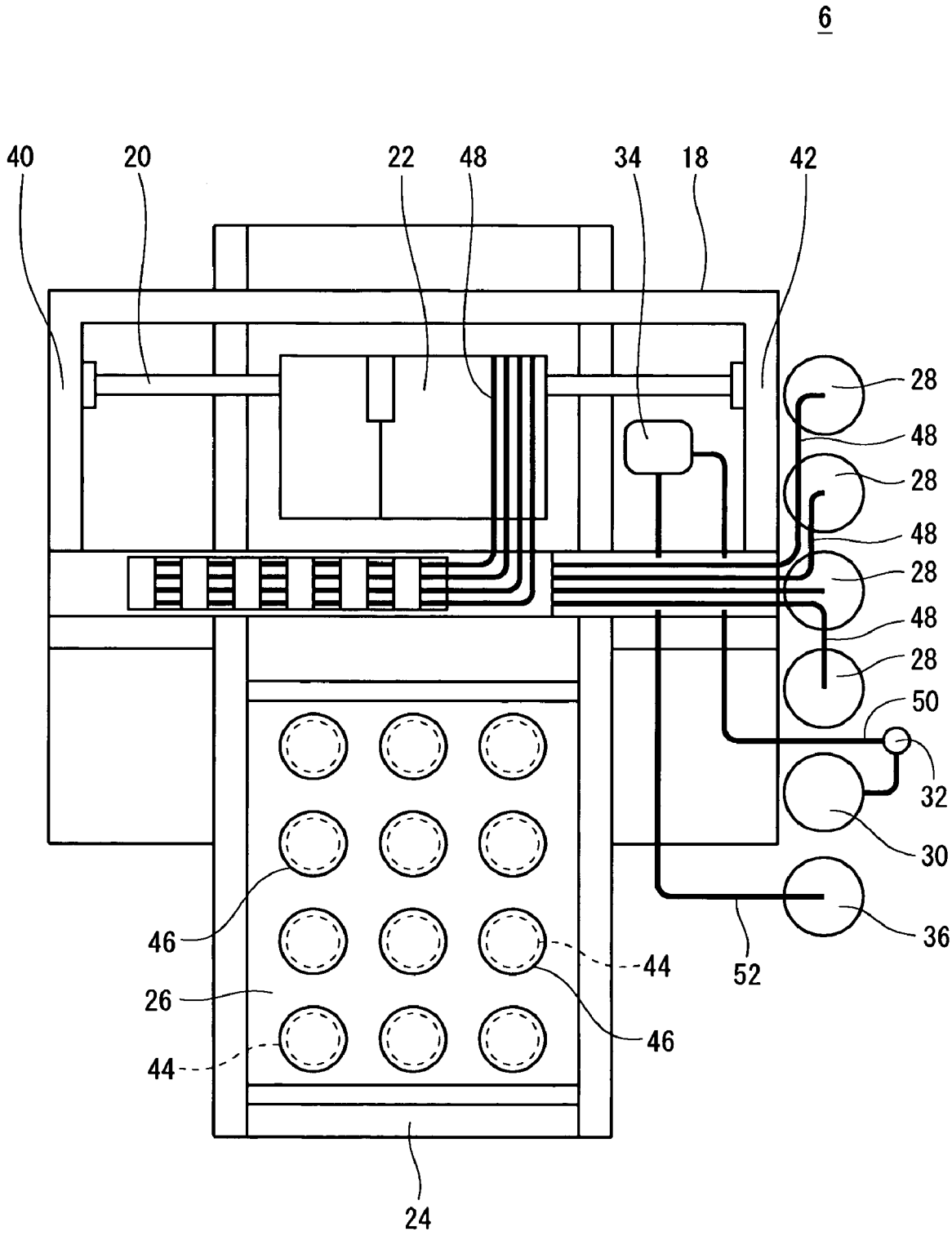
FIG. 2 is a plan view showing an ink jet printer in the marking device of FIG. 1.
Figure 3:
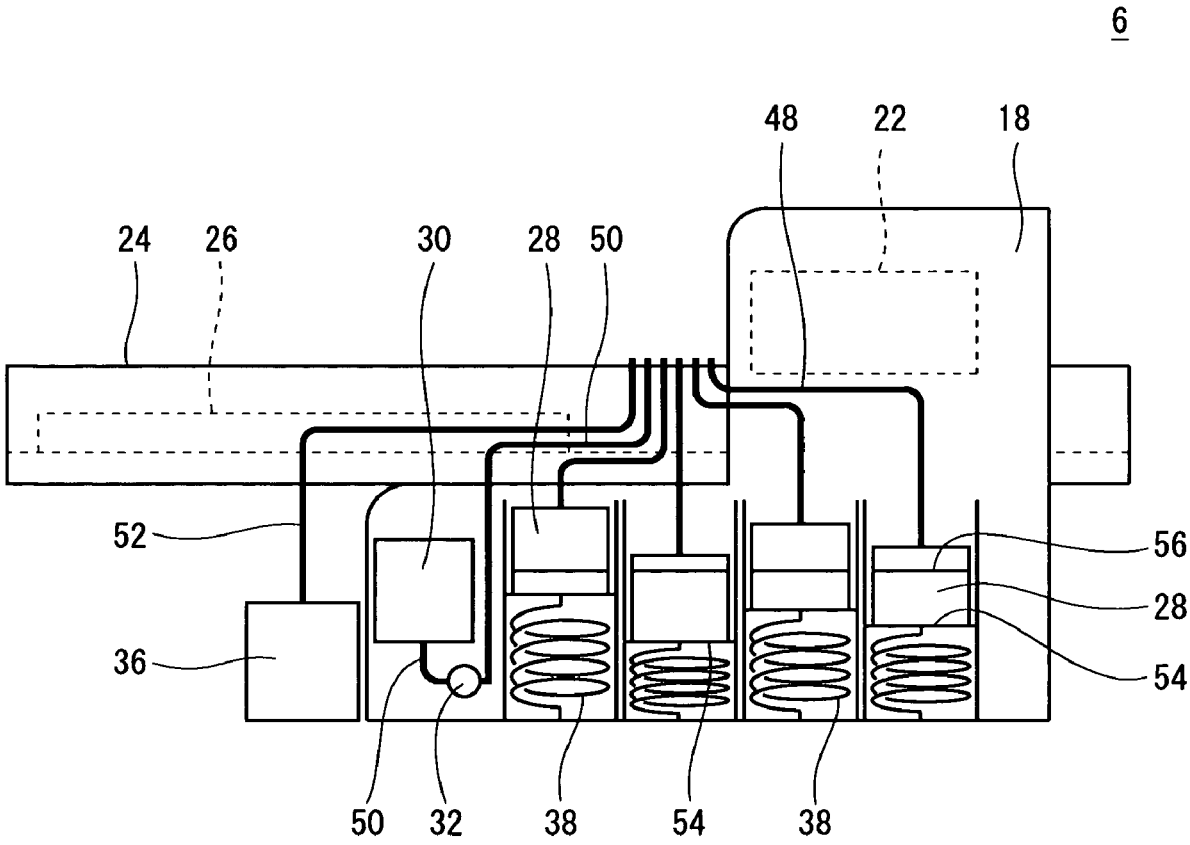
FIG. 3 is a right side view showing the ink jet printer in the marking device of FIG. 1.

FIG. 2 is a plan view showing the ink jet printer 6 of the marking device 2 in FIG. 1 and FIG. 3 is a right side view showing the same. The printer 6 includes a body 18, a guide rail 20, an ink jet head 22, a slide table 24, a tray 26, four ink vessels 28, a solvent vessel 30, a pump 32, a rest 34 and a waste liquid vessel 36. The slide table 24 and the tray 26 constitute a stand. The printer 6 also includes a coil spring 38 to be an elastic member.

The body 18 includes a left wall 40 and a right wall 42. The guide rail 20 is stretched between the left wall 40 and the right wall 42. The head 22 is coupled to the guide rail 20. The head 22 is guided by the guide rail 20, and at the same time, is moved in a transverse direction in FIG. 2.

The slide table 24 is positioned below the head 22. The slide table 24 can be moved in a vertical direction in FIG. 2. The tray 26 is mounted on the slide table 24. A large number of openings 44 are formed on the tray 26. In the example of FIG. 2, 12 openings 44 are provided on the tray 26. A golf ball 46 is set into the opening 44.

The ink vessel 28 is filled with an ink. The ink vessel 28 is filled with each of magenta, yellow, cyan and black inks. One of the ends of a tube 48 is connected to the ink vessel 28. The other end of the tube 48 reaches the head 22. The ink is supplied from the ink vessel 28 toward the head 22 through the tube 48.

In respect of the strength of the mark, a cold setting type or hot setting type oil-based ink or an ultraviolet setting type ink is preferable. In respect of a reduction in the size and cost of the device, the cold setting type oil-based ink and the hot setting type oil-based ink are preferable, and the cold setting type oil-based ink is particularly preferable. In respect of the strength and productivity of the mark, the ultraviolet setting type ink is preferable and the ultraviolet setting type oil-based ink is particularly preferable.

The solvent vessel 30 is filled with an organic solvent. A tube 50 extended from the solvent vessel 30 reaches the rest 34 through the pump 32. A tube 52 extended from the rest 34 reaches the waste liquid vessel 36.

As shown in FIG. 3, a plate 54 is attached to the upper end of the coil spring 38. The ink vessel 28 is mounted on the plate 54. The coil spring 38 is a compression spring. The coil spring 38 presses the plate 54 upward. The loads of the ink vessel 28, the ink and the plate 54 are applied to the coil spring 38. When the load to be applied to the coil spring 38 is reduced due to a decrease in the ink, the coil spring 38 moves the ink vessel 28 upward. By this movement, the height of a liquid level 56 of the ink is maintained to be substantially constant so that the amount of the ink to be discharged is maintained to be constant.

Figure 4:
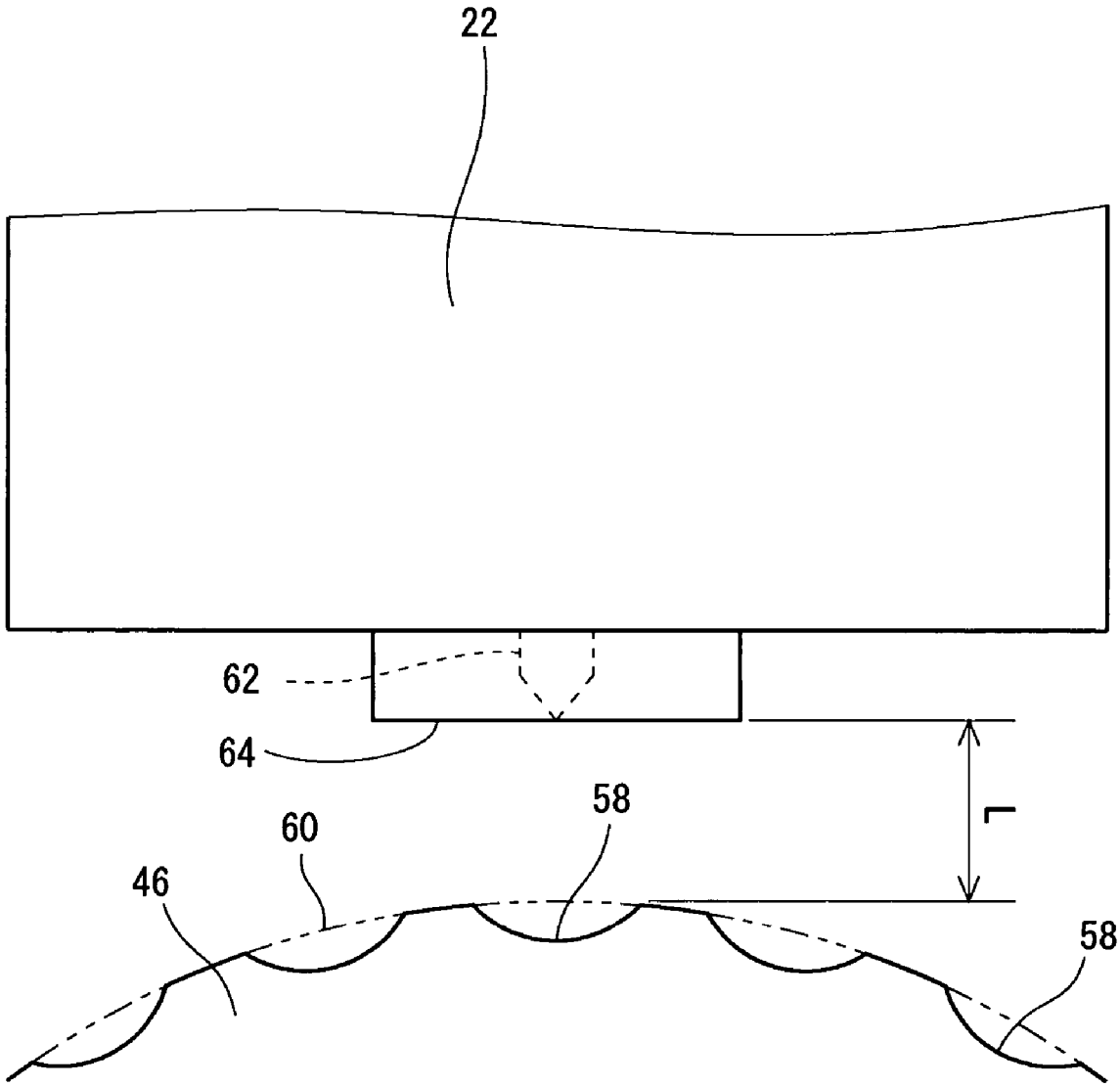
FIG. 4 is an enlarged view showing a part of a head in the ink jet printer of FIG. 2, FIG. 5(*a*) is a plan view showing the intaglio of a pad printing machine in FIG. 1, and FIG. 5(*b*) is a front view showing the intaglio in FIG. 5(*a*).

FIG. 4 is an enlarged view showing a part of the head 22 in the ink jet printer 6 of FIG. 2. FIG. 4 also shows a part of the golf ball 46. The golf ball 46 has a large number of dimples 58 on a surface thereof. In FIG. 4, a virtual sphere is shown in a two-dotted chain line 60. The virtual sphere 60 represents the surface of the golf ball 46 in the case in which it is assumed that the dimple 58 is not present. The head 22 has a nozzle 62. The tip of the nozzle 62 is coincident with a nozzle surface 64. In FIG. 4, an arrow L indicates the shortest distance between the tip of the nozzle 62 and the golf ball 46. The head 22 employs an on-demand system. The ink is discharged as a very small droplet from the nozzle 62 by means of a piezoelectric element, a heater or the like which is provided in the head 22.

Figure 5:
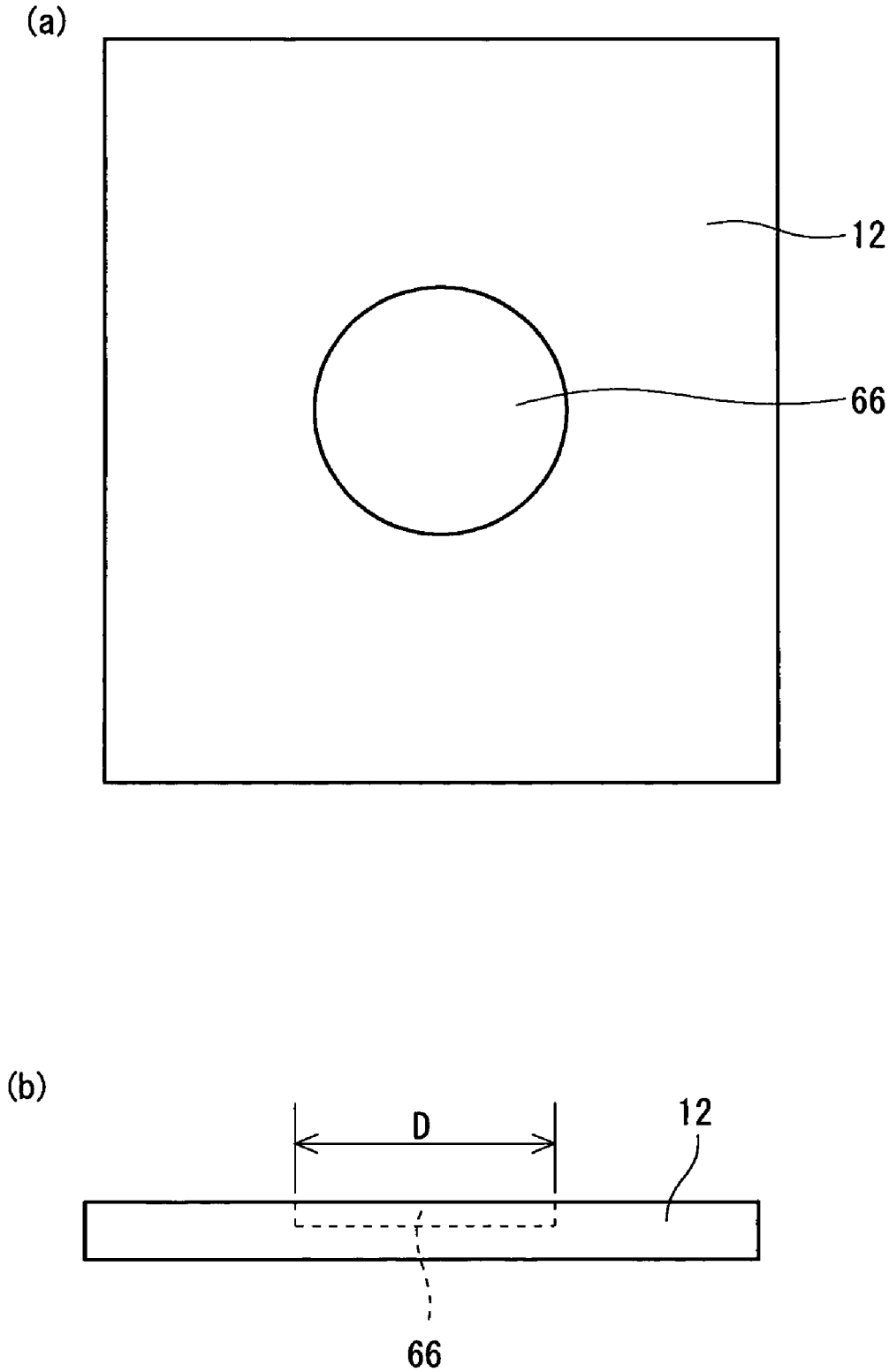

FIG. 5(*a*) is a plan view showing the intaglio 12 of the pad printing machine 8 in FIG. 1, and FIG. 5(*b*) is a front view showing the same. The intaglio 12 has an engraved portion 66. The planar shape of the engraved portion 66 is usually a circle. It is preferable that the engraved portion 66 should have a diameter D which is sufficiently larger than a mark to be formed. The diameter D is preferably equal to or larger than 12 mm, is more preferably equal to or larger than 16 mm and is particularly preferably equal to or larger than 20 mm. The diameter D is usually equal to or smaller than 30 mm. The engraved portion 66 is subjected to shading. It is preferable that the area rate of a concave portion which is generated by the shading should be equal to or higher than 90% and be equal to or lower than 98%.

In order to form a mark by the marking device 2, first of all, the specification of the mark is determined by using the computer 4. For example, a character or a graphic is input from input means such as a keyboard or a mouse to determine the specification of the mark. Based on image data stored in a storage device (typically, a hard disk), the specification of the mark may be determined. The specification of the mark may be transmitted to the computer 4 through a communication line (typically, internet) connected to the computer 4. Based on an image read by a scanner, the specification of the mark may be determined. Based on an image photographed by a digital camera, the specification of the mark may be determined.

When the specification of the mark is determined, data on the specification are transmitted to the printer 6 through the cable 10. The data include information about the position and color of the mark. Upon receipt of the data, the printer 6 starts printing. In the printing, first of all, the slide table 24 is moved gradually upward in FIG. 2. At the same time, the head 22 is moved in a transverse direction. When the nozzle 62 and the golf ball 46 reach a predetermined positional relationship, the ink is discharged from the nozzle 62. The ink is moved to the golf ball 46 so that the mark is formed. If an oil-based ink is used, liquid drops are generated after the movement with difficulty.

The golf ball 46 is taken out and is then mounted on the cup 16 in the pad printing machine 8 automatically or manually. Next, a clear paint is supplied onto the intaglio 12. The clear paint is colorless and transparent. A typical clear paint contains polyurethane as a base material. The clear paint on the intaglio 12 is scraped away by means of a doctor blade which is not shown. By the scraping operation, the clear paint present on a portion other than the engraved portion 66 is removed from the intaglio 12. The engraved portion 66 is subjected to the shading. For this reason, the clear paint in the engraved portion 66 is not scraped away by means of the doctor blade. Next, the pad 14 is moved downward and abuts on the intaglio 12. By the abutment, the clear paint is moved from the intaglio 12 to the pad 14. Then, the pad 14 is lifted and is moved to a portion placed just above the golf ball 46. Thereafter, the pad 14 is moved downward and abuts on the golf ball 46. By the abutment, the clear paint is moved from the pad 14 to the golf ball 46. Subsequently, the pad 14 is lifted. Thus, the clear paint is applied completely. The clear paint is dried so that a coated film is formed. The coated film protects the mark.

It is preferable that the golf ball 46 should be rotated finely in the cup 16 after the application of the clear paint and the clear paint should be applied again. The golf ball 46 is rotated so that the position of the golf ball 46 to the intaglio 12 is changed. By the change, the whole surface of the mark is surely coated with the clear paint irrespective of the engraved portion 66 which is subjected to the shading.

The shortest distance L (see FIG. 4) between the tip of the nozzle 62 and the golf ball 46 is equal to or greater than 0.5 mm. The distance L is longer than a distance in a general ink jet printer using an on-demand system. The golf ball 46 has the dimple 58 on the surface thereof. When the distance L is set to be equal to or longer than 0.5 mm, a turbulent flow is suppressed. By the suppression of the turbulent flow, the ink can be prevented from sticking to the nozzle surface 64. In the ink jet printer 6 using the on-demand system, the discharge of the ink is stopped temporarily. However, the ink can be prevented from sticking to the nozzle 62. Consequently, the nozzle 62 can be prevented from being clogged due to the dryness of the ink. In the marking device 2, the nozzle 62 is clogged with difficulty also in the case in which an oil-based ink or an ultraviolet setting type ink is used. The marking device 2 is particularly suitable for the print of an own name mark in which the discharge of the ink is often stopped. By the suppression of the turbulent flow, the color unevenness of the mark is also prevented. In respect of the suppression of the turbulent flow, the distance L is preferably equal to or longer than 0.6 mm and is more preferably equal to or longer than 0.7 mm. When the distance L is excessively long, the edge of the mark is blurred. In addition, when the distance L is excessively long, a high output device is required. From these viewpoints, the distance L is preferably equal to or shorter than 5.0 mm, is more preferably equal to or shorter than 3.0 mm, and is particularly preferably equal to or shorter than 2.0 mm. As is apparent from FIG. 4, the distance L is measured based on the virtual sphere 60.

When the ink jet printer 6 is stopped, the head 22 is moved to a rightmost part. At this time, the nozzle 62 is positioned just above the rest 34. The nozzle surface 64 (that is, the tip of the nozzle 62) is immersed in a solvent (alcohol such as ethanol) filled in the rest 34. Consequently, the nozzle 62 can be prevented from being clogged due to the dryness of the ink.

The pump 32 is formed of a rubber or a synthetic resin. The pump 32 is spherical and hollow. The pump 32 is filled with the solvent. A check valve (not shown) is provided on the upstream and downstream of the pump 32. When an operator contracts the pump 32, the solvent in the pump 32 is forcibly transmitted to the rest 34 through the tube 50. When the pump 32 is restored, it is filled up with the solvent from the solvent vessel 30 through the tube 50. The pump 32 and the tube 50 constitute supply means. In the case in which the ink jet printer 6 is stopped for a long period (which is equal to or more than a half day, for example), a large amount of the solvent is supplied to the rest 34 by the contraction of the pump 32. Consequently, the nozzle 62 can be prevented from being clogged due to the shortage of the solvent. The solvent contaminated with the ink is fed to the waste liquid vessel 36 through the tube 52.

The marking device according to the present invention is suitable for printing an own name mark. The marking device can also be used for printing a main mark. The above description is only illustrative and various changes can be made without departing from the scope of the present invention.

What is claimed is:

1. A method of marking a golf ball, comprising the steps of:

printing a mark on a golf ball having a large number of dimples on a surface thereof by means of an ink jet head using an on-demand system including a nozzle in which the shortest distance from the golf ball is equal to or greater than 0.7 mm, applying a clear paint on the mark by using a pad and an intaglio subjected to shading, relatively changing a position to the intaglio of the golf ball to which the clear paint is applied; and applying the clear paint on the mark again by using the pad and the intaglio, wherein a whole surface of the mark is surely coated with the clear paint irrespective of the engraved portion subjected to shading.

2. The marking method according to claim 1, wherein the intaglio has an engraved portion, and a diameter-D of the engraved portion being equal to or larger than 12 mm and equal to or smaller than 30 mm.

3. The marking method according to claim 1, wherein the golf ball is rotated in the step of relatively changing a position to the intaglio of the golf ball to which the clear paint is applied.

4. The marking method according to claim 1, further comprising:

the step of supplying an ink from a vessel to an ink jet head; and wherein a position of the vessel changes corresponding to a residual amount of the ink in the vessel in the step of supplying.

5. The marking method according to claim 4, wherein an elastic member moves the vessel.

* * * * *